US005778639A

United States Patent [19]

Sireix

[11] Patent Number: 5,778,639

[45] Date of Patent: Jul. 14, 1998

[54] PROCESS FOR FITTING THE BOTTOM OF A PACKAGE

[76] Inventor: Georges Sireix, 9bis, rue St-Marc, 68400 Riedisheim, France

[21] Appl. No.: 852,991

[22] Filed: May 8, 1997

[30] Foreign Application Priority Data

May 9, 1996 [FR] France ..... 96 05802

[51] Int. Cl.[6] ..... B65B 31/04; B65B 7/28

[52] U.S. Cl. ..... 53/432; 53/486; 53/289

[58] Field of Search ..... 53/289, 432, 486

[56] References Cited

U.S. PATENT DOCUMENTS

| | | | |
|---|---|---|---|
| 2,293,142 | 8/1942 | Johnson . | |
| 2,339,896 | 1/1944 | Waters | 53/289 |
| 3,590,557 | 7/1971 | Vogel | 53/289 |
| 3,674,060 | 7/1972 | Ruekberg | 141/83 |
| 3,979,876 | 9/1976 | Moore et al. . | |
| 4,338,765 | 7/1982 | Ohmori et al. . | |

FOREIGN PATENT DOCUMENTS

| | | |
|---|---|---|
| 732529 | 3/1943 | Germany . |
| 4414156 | 4/1994 | Germany . |

*Primary Examiner*—John Sipos
*Assistant Examiner*—James P. Calve
*Attorney, Agent, or Firm*—Kane, Dalsimer, Sullivan, Kurucz, Levy, Eisele and Richard, LLP

[57] ABSTRACT

The process relates to the fitting of a bottom of a package formed from a tubular body (1) of non-round section. The open end of the body (1) is inserted between two fixed opposed jaws (M1, M2). Since the distance between the jaws (M1, M2) is less than the distance between the clamped portions (2, 3), the portions (4, 5) which are not clamped deform. Thus, when fitting the bottom, the air escapes and by applying a clamping force to the side walls of the package (1), some of the air still in the body (1) is evacuated before sealing.

6 Claims, 2 Drawing Sheets

PROCESS FOR FITTING THE BOTTOM OF A PACKAGE

FIELD OF THE INVENTION

The present invention relates to a process for fitting the bottom of a package comprising a tubular body of non-round cross section, closed by a cover and containing the product to be packaged, said bottom having the shape of a cup whose dimensions correspond to the cross section of the tubular body, the cup being fixed on after its insertion by means of a male tool into the body, by activating an adhesive and folding over the edge of the tubular body.

PRIOR ART

In Patent Application EP-A-0,668,151 of the Applicant, a process has been proposed for manufacturing a tubular package, preferably made of a recyclable material such as paper or board, the cover and the bottom of which are also made of at least similar material. After having fixed the cover and the tamperproof membrane, the package is filled with the product to be packaged and the bottom is fixed. The bottom is a cup having the dimensions and the shape of the cross section of the tubular body and it is inserted into the body using a male tool. However, during the insertion of this cup, which rubs against the inner perimeter of the tubular body, the air which is expelled by the movement of said cup has trouble in escaping, which either slows down the process of insertion and eventually the fixing of the bottom, or an overpressure is created inside the package which is not desirable. On the contrary, it is desirable, after sealing the package, to allow a negative pressure to remain inside the package. This negative pressure on the one hand allows better preservation of the packaged product, and on the other hand, should the package overheat, prevents the creation of an overpressure inside the package which could destroy its sealing.

Various methods have been proposed for allowing this air to be evacuated, especially by the use of a negative pressure source for evacuating it, and thus allowing the cup to be fitted. This way of proceeding has drawbacks since, depending on the shape of the section of the tubular body, it is sometimes difficult to seal perfectly when there is a negative pressure and this results in variations in internal pressure which may impair the sealing of the package.

SUMMARY OF THE INVENTION

The object of the present invention is to propose a process enabling these drawbacks to be overcome using simple means.

The process according to the invention consists of the following steps:

a) the open end of the tubular body is inserted between two fixed opposed jaws which perfectly match two opposed parts of the end of the tubular body and the distance between the two jaws being less than the distance between said opposed parts so that those parts which are not clamped in said jaws undergo non-permanent deformation by moving away from each other;

b) the bottom is fitted by means of a punch, said bottom being held in its final position by said fixed jaws and the punch;

c) two opposed regions of the lateral surface of the tubular body are clamped by two clamping members which lie below two movable jaws intended to act on those portions of the free end of the tubular body which are not clamped by the fixed jaws in order to expel, at least partly, the air contained in the tubular body;

d) the movable jaws are clamped in order to bring the entire inner edge of the free end of the tubular body into contact with the cup;

e) the adhesive film is activated and, thereafter, the closed package is released.

The advantage of the present invention resides in the fact that by using simple means to apply opposed forces on diametrically opposed surfaces of the package, the edge of the package deforms sufficiently to allow insertion of the cup while at the same time enabling the air expelled by this insertion to escape between the edge of the cup and the deformed edge of the package. It is clear that the process can be applied to a package allowing slight elastic deformation. In addition, the air contained in the package is partially evacuated by clamping the side walls of the tubular body.

It is quite clearly intended that the deformations to which the package is subjected should remain within the elastic region of the material in order to avoid any damage to the package.

According to one embodiment, if the section of the package is rectangular the fixed jaws act on the short sides of the surface of the tubular body.

According to another embodiment, the section of the package is elliptical and the fixed jaws grip the regions lying on either side of the ends of the major axis of the ellipse.

According to another embodiment, the section has a semicircular shape and the fixed jaws grip the regions lying at the ends of the chord.

Finally, according to another embodiment and in order to be able to speed up the bottom-fitting procedure, the die for forming the cup of the bottom is provided with suction channels in order to allow rapid evacuation of the air expelled by fitting the bottom into the tubular body.

BRIEF DESCRIPTION OF THE DRAWINGS

The invention will be described in more detail with the aid of the appended drawing.

DESCRIPTION OF THE PREFERRED EMBODIMENTS

Figure 1:
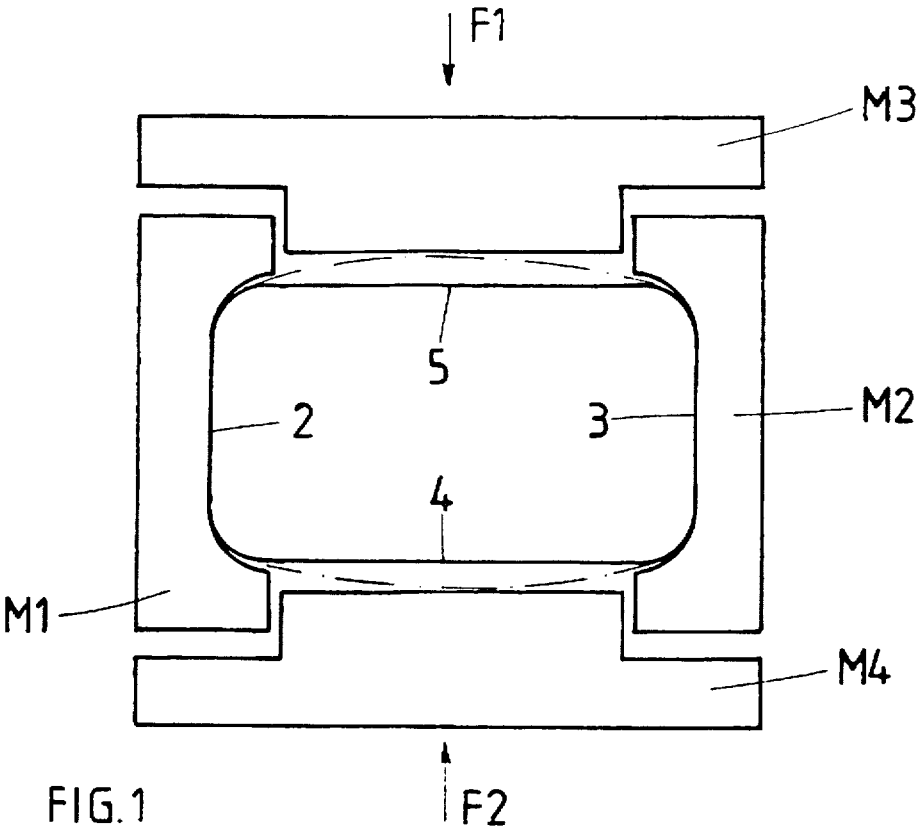
FIG. 1 is a view from above of the tubular body of a package, together with the jaws.
Figure 2:
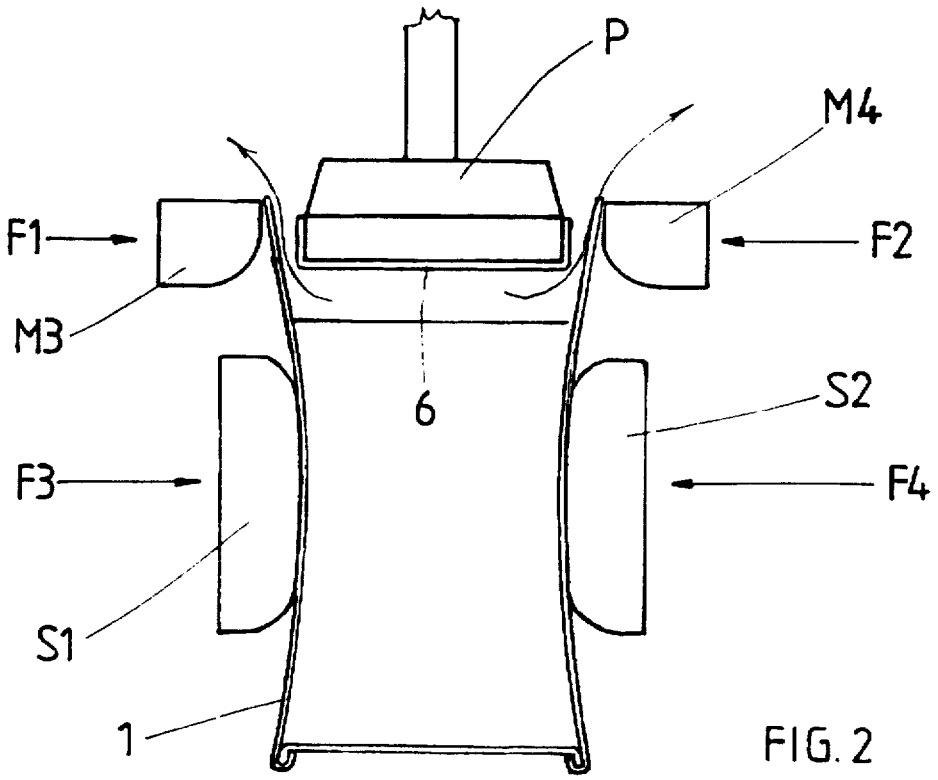
FIG. 2 is a side view.
Figure 3:
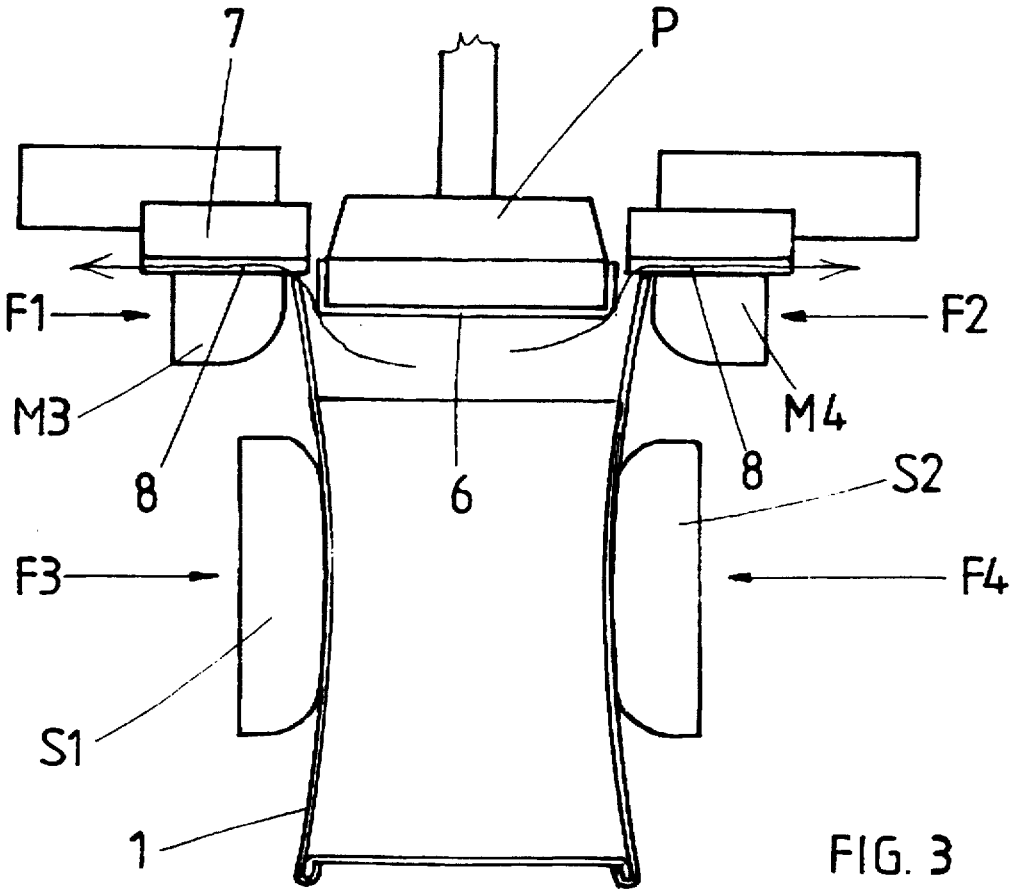
FIG. 3 is a side view of an embodiment.

A package 1 of approximately rectangular cross section, one of the ends of which is already closed off by a cover and optionally a sealing membrane, and already containing the product to be packaged, is inserted between two fixed jaws M1, M2 which have surfaces corresponding to the shape and dimensions of the lateral surface of the two opposed portions 2, 3 of the package 1. In the present case, the two faces having the smaller surface area are chosen. It is necessary that the jaws M1, M2 match said faces, since the separation between the jaws is less than the separation of the faces 2, 3 of the package so that the other two sides 4, 5 of the edge of the package move further apart.

The cup 6 which will form the bottom is fitted, between the jaws M1 and M2, by means of a punch P having the shape of this cup, the latter thus being in its final position. Thereafter, opposing forces F3 and F4 are applied against the two opposed portions of the lateral surface of the package 1, and especially in regions lying under two movable jaws M3 and M4, by means of two clamping members S1 and S2. This clamping has the effect of expelling at least some of the air still in the tubular body 1. Thereafter, while still maintaining the clamping forces S3 and S4, two jaws M3 and M4 are moved closer to each other, applying forces F1 and F2 in order to press the edges 4 and 5 of the package against the corresponding edge of the cup 6. After this, the adhesive film is activated by heating, either by high frequency or by any other similar means, thus obtaining the sealing of the bottom to the edge of the tubular body 1. Thereafter, the forces F1, F2, F3 and F4 are released and the package resumes it final shape since the forces F3, F4, as well as the separation of the jaws M1 and M2 are designed to cause no permanent deformation of the package.

Whatever the shape of the cross section, other than round, the process can be used successfully.

Thereafter, the package continues its manufacturing cycle, as stipulated in the aforementioned patent by the same Applicant, (seaming, etc.).

Thus, by means of a simple process a cup having the final shape is able to be fitted without the air in the package slowing down the operation of fitting this cup, since air can move during the movement of the cup via the space existing between the deformed edge 4 and 5 (drawn by the dot-dash lines in FIG. 1) and the cup and thereafter a still further part of the air can be expelled using the clamping members S1 and S2.

For the purpose of being able to fit the bottom 6 of the package 1 at a very high rate, the die 7 for forming the cup of the bottom 6, described in the aforementioned Patent Application by the same inventor, is provided by channels 8 connected to a suction source (not shown). Thus, while the bottom is being fitted by the punch P, the expelled air is sucked out through the channels 8 as well as possible particles of the packaged product, thus preventing contamination of the forming die 7; in respect of the rest of the process this is identical to that described previously.

What is claimed is:

1. A process for fitting the bottom of a package comprising a tubular body of non-round cross section, closed by a cover at one end and having an open end at the other end and containing the product to be packaged, said bottom having the shape of a cup whose dimensions correspond to the cross section of the tubular body, the cup being fixed on after its insertion by means of a male tool into the body, by activating an adhesive and folding over the edge of the tubular body, the process consisting of the following steps:

a) the open end of the tubular body is inserted between two fixed opposed jaws (M1, M2) which perfectly match two opposed parts (2, 3) of the open end of the tubular body (1) and the distance between the two jaws being less than the distance between said opposed parts to clamp said opposed parts and leaving other parts unclamped so that said unclamped parts (4, 5) in said jaws undergo non-permanent deformation by moving away from each other;

b) the bottom is fitted by means of a punch (P), said bottom being held in its final position by said fixed jaws (M1, M2) and the punch (P);

c) two opposed regions of the lateral surface of the tubular body are clamped by two clamping members (S1, S2) which lie below two movable jaws (M3, M4) intended to act on those portions of the free end of the tubular body which are not clamped by the fixed jaws in order to expel, at least partly, the air contained in the tubular body;

d) the movable jaws (M3, M4) are clamped in order to bring the entire inner edge of the free end of the tubular body into contact with the cup;

e) the adhesive film is activated and, thereafter, the closed package is released.

2. The process as claimed in claim 1, wherein the separation of the two fixed jaws and the clamping by said members are chosen so as not to cause permanent deformation of the tubular body.

3. The process as claimed in claim 1, wherein the tubular body has a rectangular section and wherein the fixed jaws (M1, M2) grip the short sides (2, 3) of said rectangular section.

4. The process as claimed in claim 1, wherein the tubular body has an elliptical section and the fixed jaws grip the regions lying on either side of the ends of the geometrical major axis of the ellipse.

5. The process as claimed in claim 1, wherein the tubular body has a semicircular section and the fixed jaws grip the regions lying at the ends of the chord.

6. The process as claimed in claim 1, wherein, said cup is formed by a die and while the bottom (6) is being fitted, the air expelled by introduction of the punch (P) with the cup (6) is sucked out through two suction channels (8) located on the die (7) for forming the cup of the bottom (6).

* * * * *